US005341755A

United States Patent [19]

Kawasaki

[11] Patent Number: 5,341,755

[45] Date of Patent: Aug. 30, 1994

[54] AUTOMATED MULTIPLE-NEEDLE SEWING MACHINE

[75] Inventor: Kiyoshi Kawasaki, Ohme, Japan

[73] Assignee: Tachi-S Co., Ltd., Tokyo, Japan

[21] Appl. No.: 51,214

[22] Filed: Apr. 23, 1993

[51] Int. Cl.[5] ..... D05B 1/08

[52] U.S. Cl. ..... 112/163; 112/322; 112/121.12

[58] Field of Search ..... 112/163, 164, 165, 166, 112/167, 318, 320, 311, 322, 121.12, 121.29

[56] References Cited

U.S. PATENT DOCUMENTS 4,066,028 1/1978 Hornkohl ..... 112/121.29
4,483,262 11/1984 Keeton ..... 112/121.12
5,193,474 3/1993 Urai et al. ..... 112/163

FOREIGN PATENT DOCUMENTS 52-148355 12/1977 Japan .
64-34394 2/1989 Japan .

*Primary Examiner*—Peter Nerbun
*Attorney, Agent, or Firm*—Browdy and Neimark

[57] ABSTRACT

An automated multiple-needle sewing device which comprises a table, a guide plate movable on the table, a multiple-needle sewing mechanism, a feed roller mechanism, a yarn cutting mechanism, and a guide plate returning mechanism. A material to be sewn is placed on the guide plate and undergoes the sewing, feeding and yarn cutting processes in an automated manner. The guide plate is automatically returned to an initial position for mounting a new other material to be sewn. The feed roller mechanism includes a lifting device for lifting or raising a shaft and feed roller(s) away from contact with the material and guide plate being fed.

11 Claims, 6 Drawing Sheets

AUTOMATED MULTIPLE-NEEDLE SEWING MACHINE

BACKGROUND OF INVENTION

1. Field of the Invention

The present invention relates to an automated multiple-needle sewing machine which is capable of sewing a pre-formed material, such as a central cover section of a trim cover assembly for an automotive seat.

2. Description of Prior Art

A typical type of trim cover assembly for an automotive seat is formed to have a central cover section and a pair of lateral bolster cover sections for covering the corresponding portions of a foam cushion member. Conventionally, the central cover section in this sort of trim cover assembly is of a three-layer lamination type comprising a top cover member, a foam wadding of a urethane foam slab material and a wadding cover in this order. Those three layers have been cut into a predetermined proper shape corresponding to the flat central seating area of the seat and then been sewn together by means of a multiple-needle sewing machine, such that a plurality of decorative rectilinear seams are left thereupon.

Normally, the multiple-needle sewing machine has a plurality of sewing needles disposed transversely thereof or in the width-wise direction thereof, and thus, the rows of those needles lie in a direction orthogonal to the direction wherein the foregoing trim cover assembly lamination material is fed toward the needles for sewing, as known from the U.S. patent application Nos. 838,367 now U.S. Pat. No. 5,193,474 and 838,374 assigned to the assignee of the present invention.

However, in operating this sort of conventional multiple-needle sewing machine, it has been found defective that an operator has to keep stretching the lamination material and feeding it to the needles, with his or her hands, until the sewing is completed, in an attempt to avoid any slackened or crease portion in the material as well as a curvature in sewing.

A solution to this problem may be conceived by providing a securing plate in the sewing machine, which is designed to secure the trim cover assembly material thereon in an uniformly stretched state and slidable forwardly and backwardly with respect to the sewing machine body having the plural needles. But, this gives the operator a hard time, because he or she needs to move from one end to another end of the machine to carry again the securing plate to a feeding position for securing again a new other cover base material thereon for next sewing stage.

SUMMARY OF THE INVENTION

With the above-stated shortcomings in view, it is therefore a primary purpose of the present invention to provide an automated multiple-needle sewing device which permits automatic feeding and sewing of a base material to be sewn.

In order to achieve such purpose, in accordance with the present invention, there is basically provided an automated multiple-needle sewing device which comprising:

a multiple-needle sewing mechanism;

a table extending in a forward direction and rearward direction relative to the multiple-needle sewing mechanism, wherein a forward area and a rearward area are defined on the table in relation to the multiple-needle sewing mechanism;

a guide means upon which a material to be sewn is securely mounted, the guide means being movable on the table along a longitudinal direction thereof, passing through the multiple-needle sewing mechanism;

a feed roller mechanism disposed at the rearward area, the feed roller mechanism including:

(a) a shaft extending transversely of the table;

(b) at least one feed roller fixed on the shaft; the feed roller being normally disposed for contact with both guide means and material in order to feed them;

(c) a gear means provided on the shaft, the gear means being operatively connected with a driving source; and (d) a lifting means for lifting the shaft upwardly so as to raise the feed roller out of contact with the guide means and the material thereon;

a yarn cutting mechanism which is disposed more rearwardly than the feed roller mechanism at the rearward area; and a guide means returning mechanism which is disposed more rearwardly than the yarn cutting mechanism, which is for returning the guide means to the forward area.

Thus, a plurality of base or cover materials may be fed one after another by the guide means and feed roller mechanism, subject to sewing by the multiple-needle sewing mechanism, and discharged one by one, with the guide means being returned to the forward area for mounting a new material thereon, in an automated way. The yarn cutting mechanism works to cut the non-sewn yarn portions among the materials in order to let the leading one of the materials discharged out of the device.

Preferably, the lifting means may be so arranged as to raise one end of the shaft, or raise both ends of shaft, to thereby raise the feed roller out of contact with the guide means and material thereon, so that the guide means may be pass through the feed roller when the guide means returning mechanism is operated to return the guide means to the forward area.

Moreover, according to the invention, the feed roller is driven in synchronism with a feed operation of the multiple-needle sewing device at the same speed.

Additionally, the guide means returning mechanism includes a retainer means for pressingly retaining the material at a point in the backward area, so that the material is left there when the guide means is returned to the forward area.

DETAILED DESCRIPTION OF PREFERRED EMBODIMENTS OF THE INVENTION

Figure 1:
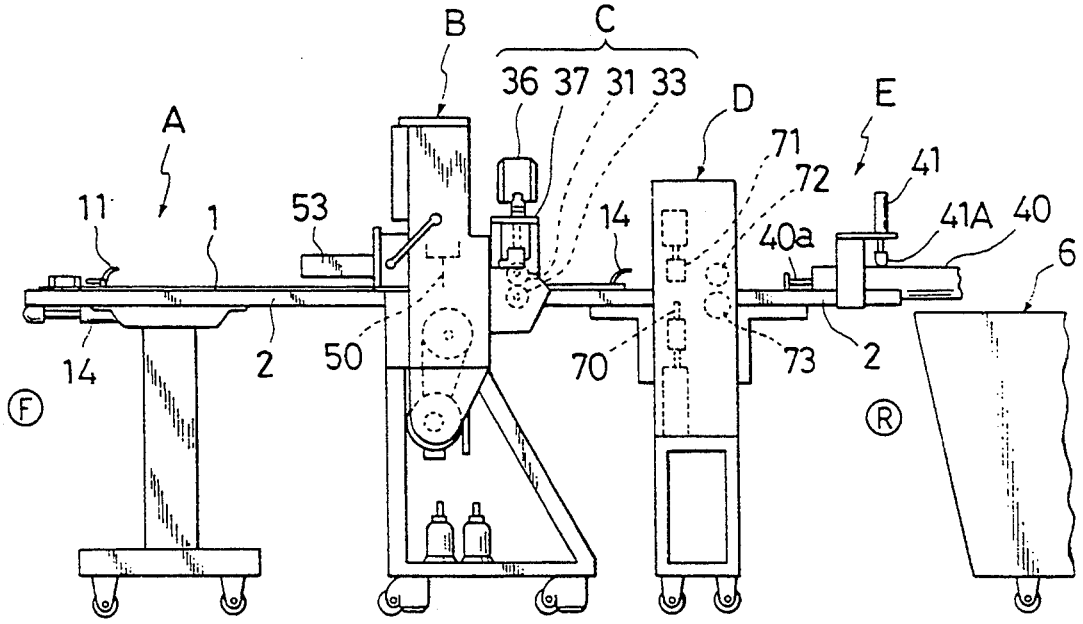
Fig. 1 is a side elevation view of an automated multiple-needle sewing device in the present invention.
Figure 2:
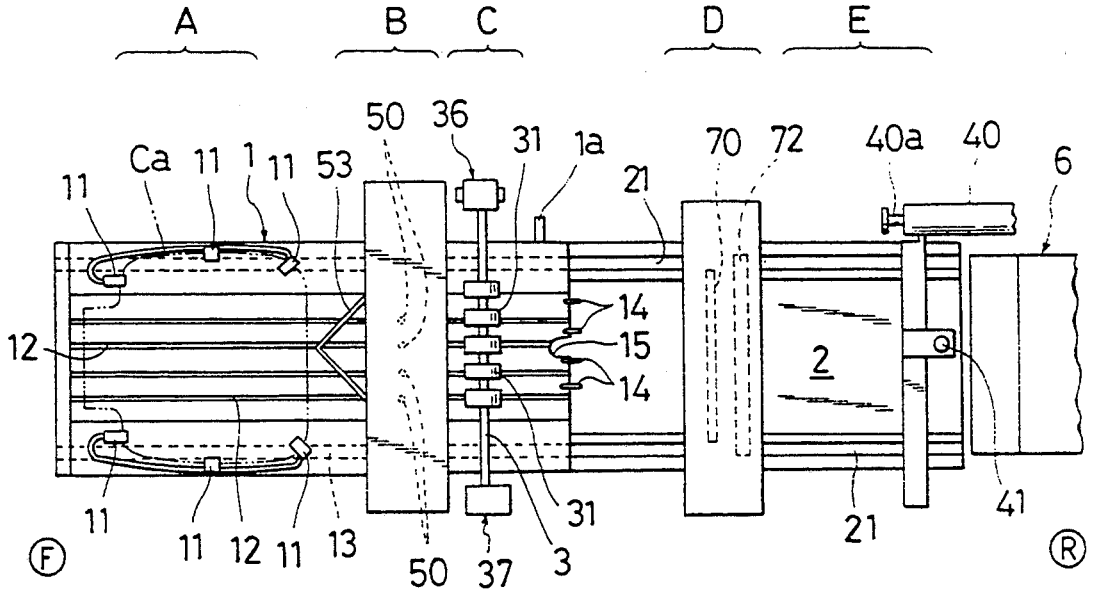
FIG. 2 is a plan view of the same in FIG. 1.

Figs. 1 and 2 schematically show one whole embodiment of automated multiple-needle sewing machine in accordance with the present invention.

As shown, the sewing machine is basically comprised of a mounting mechanism (A), a multiple-needle sewing mechanism (B), a guide roller mechanism (C), a yarn cutting mechanism (D), a guide plate returning mechanism (E), a container (6), a table (2) and a guide plate (1).

The table (2) extends from the mounting mechanism (A) at the forward side (F) to the container (6) at the rearward side (R), penetrating through the sewing, guide roller and yarn cutting mechanisms (B)(C)(D). A pair of spaced-apart lower rails (21) (21) are formed on the upper surface of the table.

The guide plate (1) has slide upper rails (13) (see FIG. 3) provided on the bottom side thereof, each being slidably fitted in the respective two lower rails (21)(21), so that the guide plate (1) is slidingly moved along the longitudinal direction of the table (2) by means of a hydraulic cylinder (14). The guide plate (1) is formed with plural rectilinear grooves (12) on the upper surface thereof of the table (2). The guide plate (1) is formed with plural rectilinear grooves (12) on the upper surface thereof. The grooves (12) extend fully from the forward end of the guide plate (1) to the rearward end thereof, and are spaced apart from one another in parallel relation at an interval equal to that among the plural needles (50) of the sewing mechanism (B). As viewed from FIG. 2, the right-side half area of this guide plate (1) is provided with a clamp device (11), forming a part of the mounting mechanism (A) , and as indicated by the two-dot chain line, a cover base material (C) of the same three-layer lamination type as the prior art one mentioned previously, is to be placed and secured firmly on that right-side half area of guide plate (1). The rearward end of guide plate (1) is formed with a notched part (15) at the central portion and provided with plural pawl members (14).

Although not shown, a sensor is provided on the guide plate (1), which is adapted to detect the presence and absence of the cover base material (C) thereon.

Figure 3:
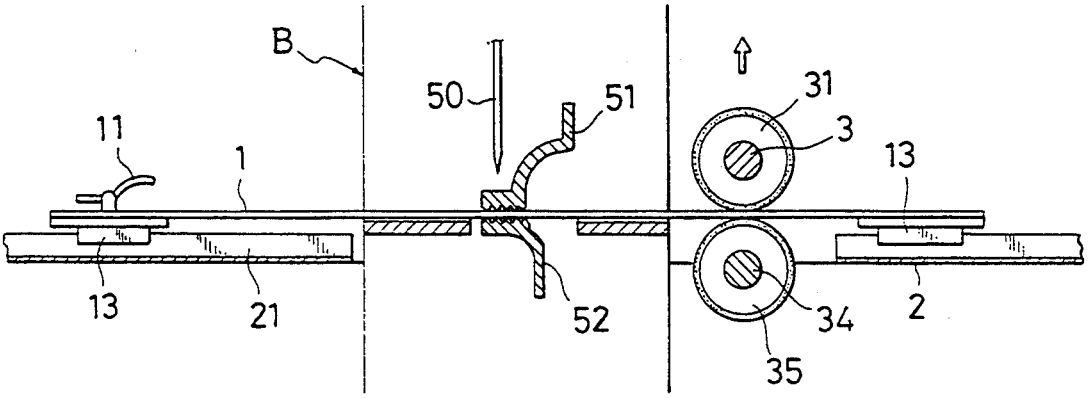
FIG. 3 is a sectional view of a multiple-needle sewing mechanism.

The multiple-needle sewing mechanism (B), as best shown in FIG. 3, is of a known construction comprising a plurality of sewing needles (50), an upper pressing member (51) and a lower feeding teeth member (52).

Designation (53) denote a V-shaped keel member fixed on the forward wall of the sewing mechanism (B), extending forwardly toward the mounting mechanism (A). The keel member (53) is adapted to stretch and eliminate a crease in the base material (C) to be sewn.

Figure 4:
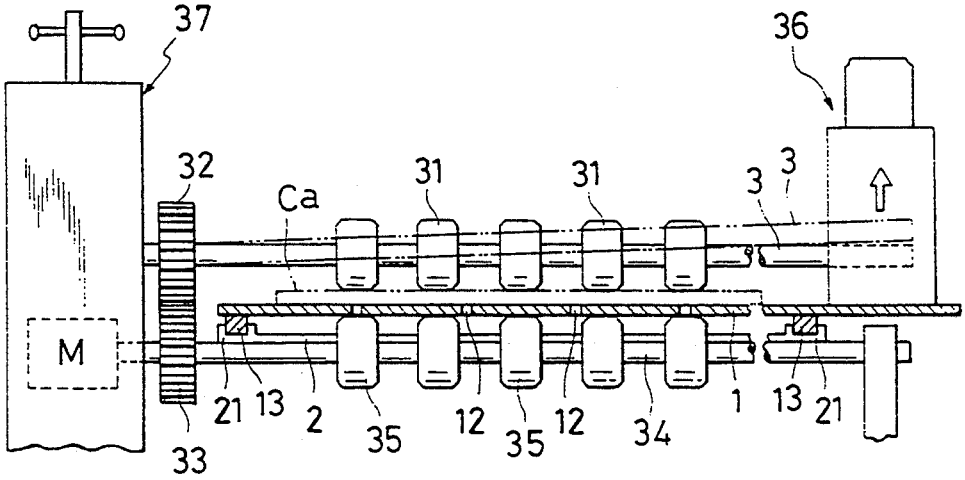
FIG. 4 is a partly broken front view showing a feed roller mechanism.

FIGS. 4 shows the structure of the feed roller mechanism (C), wherein an upper shaft (3) and a lower shaft (34) are normally extended in parallel with each other between a roller lifting device (36) and a biasing device (37), and a plurality of upper feed rollers (31) are fixed on the upper shaft (3), whereas a plurality of lower feed rollers (35) are fixed on the lower shaft (34). Both upper and lower feed rollers (31)(35) are resiliently biased into contact with each other by means of the biasing device (37). One end respectively of the upper and lower shafts (3)(34) are provided with an upper gear(32) a lower gear (32), both of which mesh with each other, and the lower shaft (34) is connected with the motor (M), whereupon operation of the motor (M) causes simultaneous rotation of both upper and lower rollers (31)(35). As can be seen from FIG. 4, the table (1) with the trim cover assembly (Ca) secured thereon is sandwiched between the upper and lower rollers (31)(32) for feed toward the rearward side ((R)).

In this regard, in accordance with the present invention, it is arranged such that the rollers (31) (32) are driven in synchronism with the feeding operation of the feed teeth member (52) of sewing mechanism (B) at a same speed, so as to feed the cover material (Ca) smoothly in the rearward direction of device.

As shown in FIG. 4, the feed roller lifting device (36) and the biasing device (37) are disposed on the opposite sides of the path along which the guide plate (1) and cover material (Ca) are moved.

Figure 5:
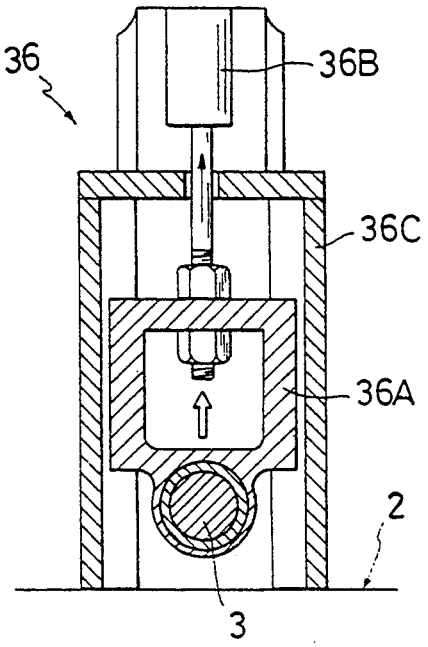
FIG. 5 is a sectional view of a lifting device.

As best shown in FIG. 5, the feed roller lifting device (36) comprises a cylindrical housing (35C), a hydraulic cylinder (36B) disposed above the housing (35C), and an inner bearing member (36A) slidable within the housing (35C) vertically. The rod of the cylinder (36B) is connected to the upper wall of the bearing member (36A). The bearing member (36A) has a bottom wall at which one end portion of the upper shaft (3) is rotatably supported.

Figure 7:
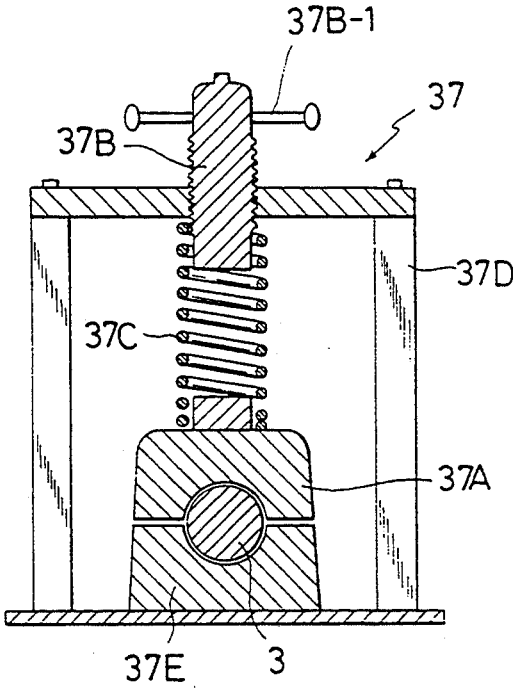
FIG. 7 is a sectional view of a biasing device.

As best shown in FIG. 7, the biasing device (37) comprises a base bearing (37E) fixed at a frame forming a part of the feed roller mechanism (C), a separate upper bearing (37A) which is to engage the base bearing (37E) to embracingly support another end of the upper shaft (3), a support frame (37D), a screw-type spring force adjustment member (37B) which penetrates through the upper frame part of the support frame (37D) in a threaded engagement therewith, and a compression coil spring (37C) interposed between the lower free end of the adjustment member (37B) and the top portion of the upper bearing. Rotating the handle (37B-1) of adjustment member (37B) causes the member per se to move vertically to thereby adjust the biasing force of the spring (37C) to bias the upper bearing (37A) downwardly against the base bearing (37E), so as to increase or decrease the support force for the upper shaft (3).

Figure 6:
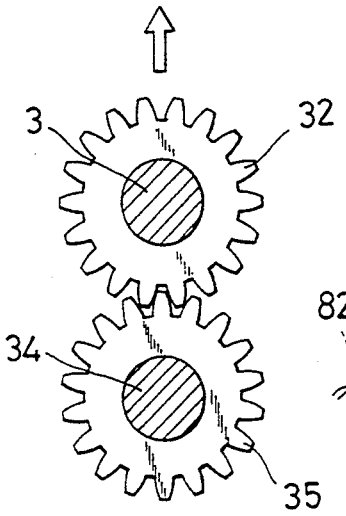
FIG. 6 is a view explaining a mesh engagement between upper and lower gears.
Figure 10:
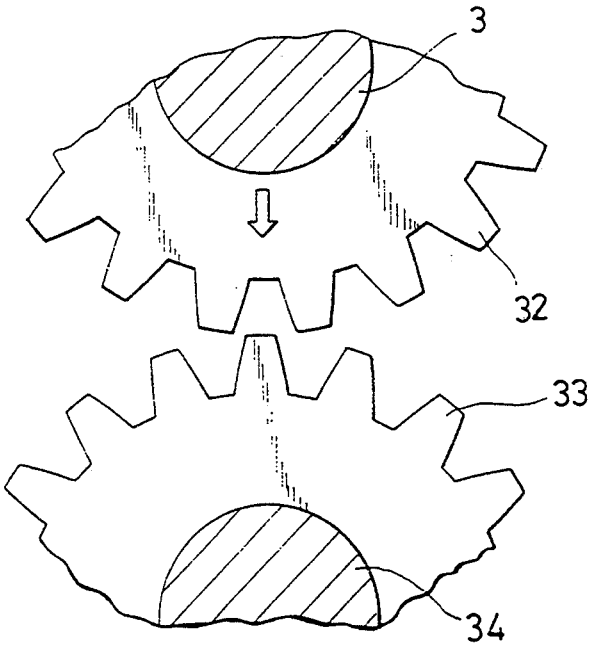
FIG. 10 is a partly broken view showing a mesh engagement between upper and lower gears of such another embodiment in FIG. 9.

According to the invention, the lifting device (36) is normally at work to keep lifting or raising one end of the upper shaft (3) as indicated by the two-dot chain line in FIG. 4, to thereby allow free movement of the guide plate and cover material (1)(Ca) between the upper and lower rollers (31)(35). At this point, the bearing member (35A) is moved upwardly by the cylinder (36B) in the arrow direction in FIG. 5 to raise the upper shaft (3) at a predetermined level of such a degree that the adjacently disposed upper gear (32) remains in mesh with the lower gear (34). For that purpose, the teeth of both gears (32)(34) should be of a sufficient length for keeping their mutual mesh engagement when the upper gear (32) is displaced away from the lower one (34), as indicated in FIGS. 6 and 10. The upper gear (32) is also positively biased into a firm mesh engagement with the lower gear (35) by means of the biasing device (37).

Figure 9:
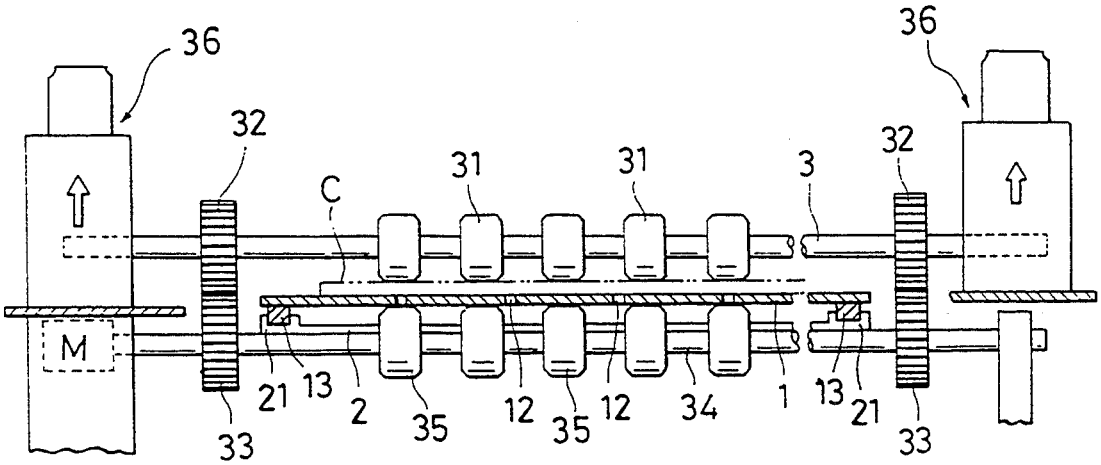
FIG. 9 is a partly broken front view showing another embodiment of the feed roller mechanism.

FIG. 9 illustrates another embodiment of the lifting device (36). In this particular embodiment, there are provided a pair of the lifting device (36) (36) and a pair of upper and lower gears (32)(32) at both end portions of the upper shaft (3). This structure is effective in raising the upper shaft (3) from the lower one (34) in parallel therewith, to provide a sufficient clearance between the upper and lower feed rollers (31)(35) as compared with the foregoing first embodiment of lifting device (36) as in FIG. 4. In this instance also, the teeth of both gears (32)(34) should be of sufficient length for keeping their mutual engagement when the two upper gears (32) are raised from the lower ones (33). This arrangement prevents interference or incomplete mesh between the upper and lower gears (32)(33) when they reengage with each other.

Figure 8:
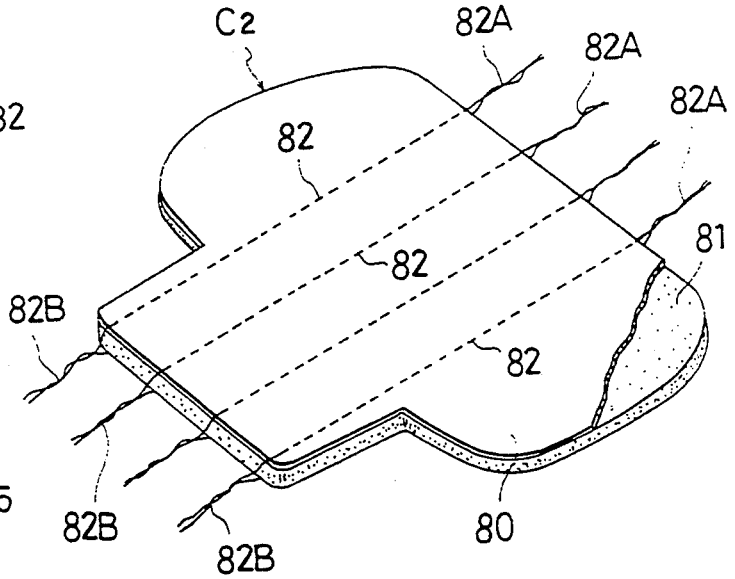
FIG. 8 is a perspective view of a resultant sewn cover material.
Figure 12:
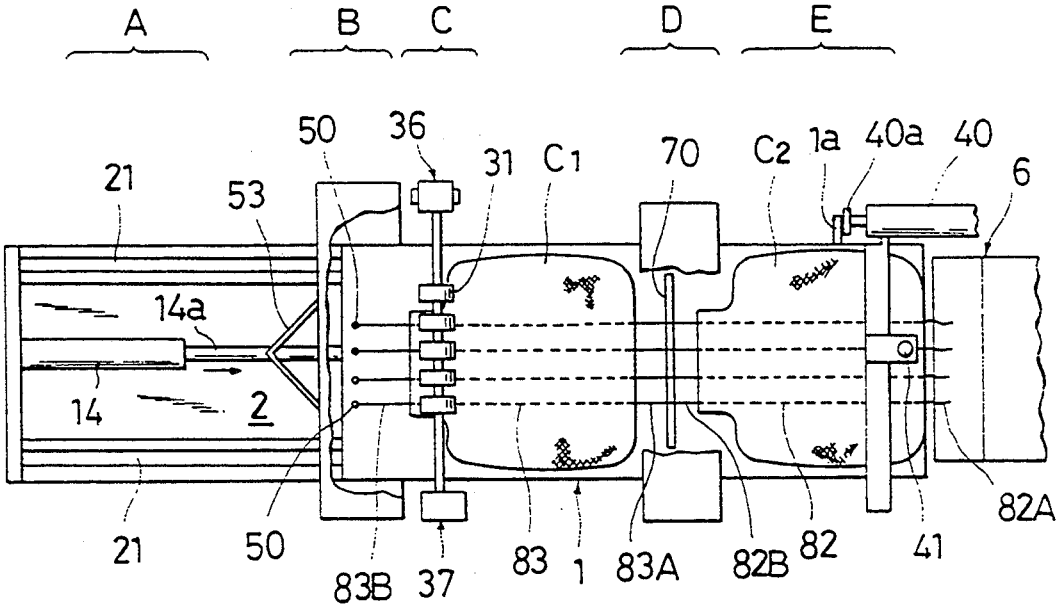

The yarn cutting mechanism (D), as shown in FIGS. 1 and 2, comprises a fixed upper receiving member (71) made of a synthetic resin material, a lower blade member (70), an upper feed roller (72) and lower feed roller (73). The lower blade member (7) is moved vertically toward and away from the upper receiving member (71) by operation of a suitable hydraulic cylinder (not clearly shown). Referring now to FIGS. 8 and 12, the present device is capable of feeding at least three pieces of cover material (e.g. C1, C2) on the table (2). In operation, after sewing, the cover materials (C1)(C2) are in the state of being connected with other via the plural yarns (83), and the yarn non-sewn portions (82A, 82B, 83A, 83B . . . ) between the two sewn cover materials (C1)(C2) are each to be cut by the lower blade member (70) being raised toward and received by the upper receiving member (71).

The guide plate returning mechanism (E), as shown in FIGS. 1 and 2, is disposed at the rearward end portion of the device at (Ⓡ) where the sewn resultant cover material is discharged down into the container (6). The mechanism (E) comprises a longitudinal cylinder (40) having a rod (40*a*) to be extended and retracted along the longitudinal direction of the table (2) and a retainer (41, 41A) for temporarily retaining the cover material (Ca) which is carried in this particular area under the mechanism (E). Although not shown, both cylinder (40) and retainer are electrically connected with a microswitch located at a point to contact the guide plate (1) which reaches this particular rearward end side (Ⓡ). Thus, when the guide plate (1) with the sewn resulting cover material (e.g. C2 in FIG. 12) thereupon reaches there, the microswitch is turned on to actuate the cylinder (41) of the retainer to lower the retainer end (41A) to push the rearward end of the resultant sewn cover material. At this moment, the lug (1*a*) of the guide plate (1) is contacted with the end of rod (40*a*) of longitudinal cylinder (40). Then, the cylinder (40) is actuated to extend its rod (40*a*) to push and bring back the guide plate (1) toward the initial area in the mounting mechanism (A). But, the cover material is retained by the retainer end (41A) of retainer and left upon the table (2), as can be seen from FIG. 13.

Figure 11:
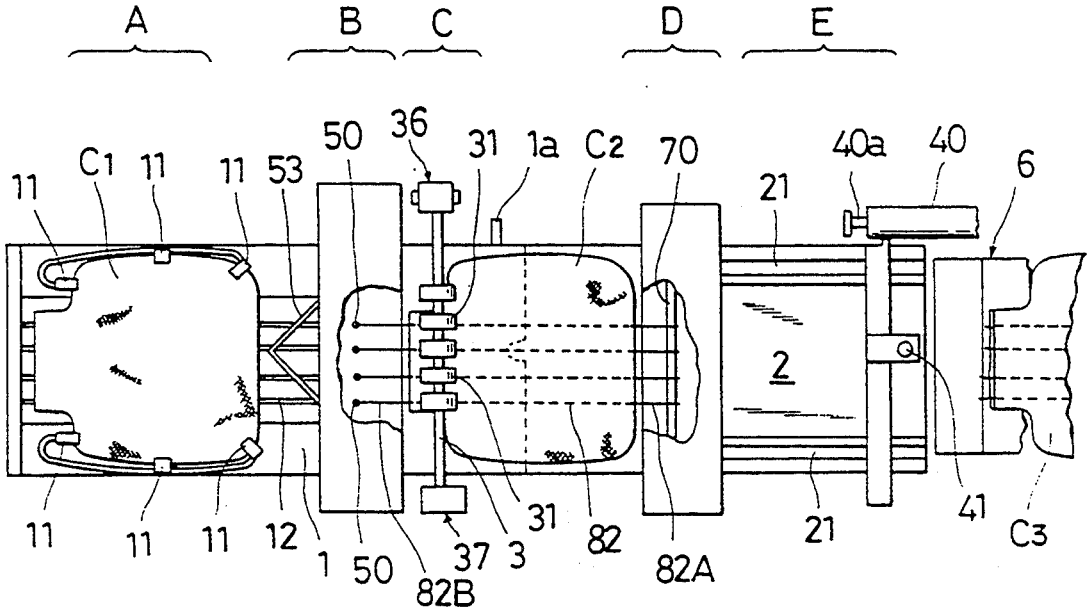
FIGS. 11, 12 and 13 are views explaining a process for sewing the cover materials.
Figure 13:
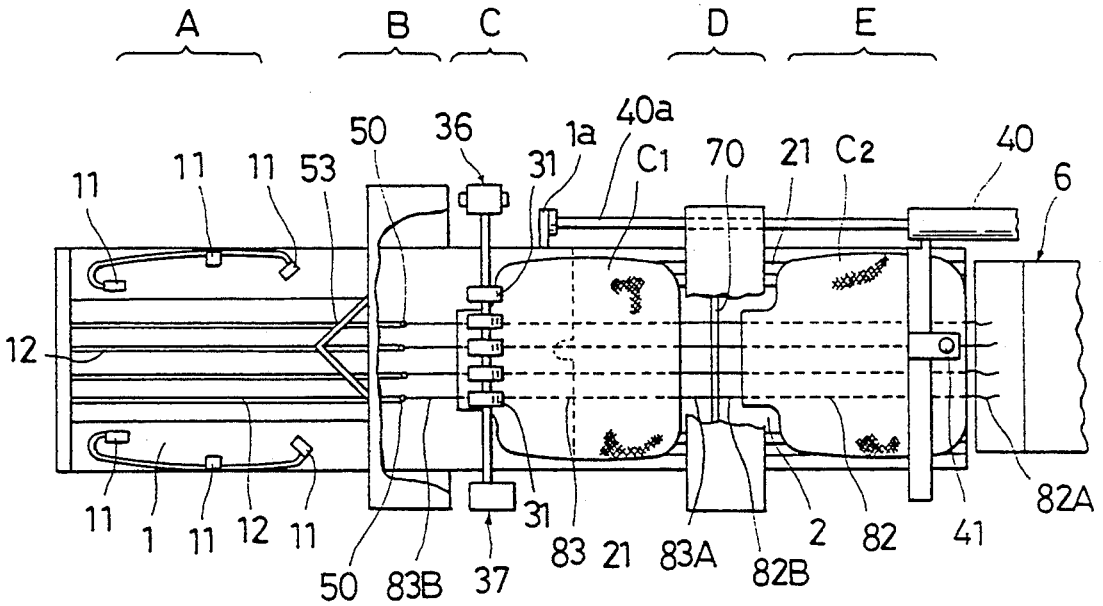

In practical operation, reference being made to FIGS. 11 to 13, a plurality of cover materials (like C1, C2 and C3) are placed and transferred, one after another in a mutually connected manner, via the plural yarns (82, 83 . . . ) being continued from the sewing mechanism (B), along the longitudinal direction of the table (2). With regard to the first cover material (C1), at first, it is mounted and secured on the guide plate (1) at the mounting mechanism (A), then upon the cylinder (14) being operated, its rod (14*a*) is extended in the rearward direction of the table (2), transferring the cover material (C1) to the sewing mechanism (B), at which time, the sewing mechanism (B) starts sewing the material (C1) and simultaneously the lifting device (36) works to lower the upper rollers (31) which has been in the raised state as indicated by the two-dot chain line in FIG. 4, so that both cover material and guide plate (C1)(1) are sandwiched between the upper and lower rollers (31)(35). The rollers (31) (35), in cooperation with the keel member (53), serve to uniformly stretch the cover material (C1), avoiding creases or slackened areas thereon. After this sewing process, the sewn cover material (C1) is located at the middle position as in FIG. 12, at which time, the leading other cover material (C2) is located at the guide plate returning mechanism (E). Also, the the lifting device (36) works to raise the upper rollers (31) and the cylinder (14) at the mounting mechanism has already been in a loose state. Then, the retainer (41, 41A) presses and retains the leading cover material (C2) on the table (2) and the longitudinal cylinder (40) is operated to extend its rod (40*a*), pushing the lug (1*a*) of guide plate (1), whereby the guide plate (1) is returned to the initial area (A) and stands ready to allow mounting of a new cover material thereon. The cutting mechanism (D) cuts the yarn interval portions (83A, 82B) between the two cover materials (C1)(C2) at one time, and when the guide plate (1) with a new cover material is again transferred in the rearward direction (i.e. toward (Ⓡ)), the plural pawls (14) at the rearward end of the guide plate (1) pushes the foregoing leading cover material (C2) and discharge same into within the container (6), like the one (C3) in FIG. 11.

Accordingly, it is appreciated that in accordance with the present invention, a plurality of cover materials can be fed one after another and subject to sewing by the multiple-needle sewing device in an automated way, without causing any crease and slackened areas on the cover materials. This does not require any labor and undesired works on the part of an operator to mount each cover material on the sewing machine.

While having described the present invention as above, it should be understood that the invention is not limited to the illustrated embodiments but any other modifications, replacements and additions may be applied structurally thereto without departing from the scope and spirit of the appended claims.

What is claimed is:

1. An automated multiple-needle sewing device, comprising:

a multiple-needle sewing mechanism;

a table extending in a forward direction and rearward direction relative to said multiple-needle sewing mechanism, wherein a forward area and a rearward area are defined on said table in relation to said multiple-needle sewing mechanism;

a guide means upon which a material to be sewn is securely mounted, said guide means being moveable on said table along a longitudinal direction thereof, passing through said multiple-needle sewing mechanism;

a feed roller mechanism disposed at said rearward area, said feed roller mechanism including:

(a) a pair of shafts extending transversely of said table;

(b) at least one feed roller fixed on each shaft of said pair of shafts; said feed roller being normally disposed for contact with both said guide means and material in order to feed them;

(c) a gear means provided on said pair of shafts, one of said gear means being operatively connected with a driving source; and (d) a lifting means for lifting one of said shafts upwardly so as to raise said feed roller out of contact with said guide means and said material thereof;

a yarn cutting mechanism which is disposed more rearwardly than said feed roller mechanism at said rearward area; and a guide means returning mechanism which is disposed more rearwardly than said yarn cutting mechanism, said guide means returning mechanism being for returning said guide means to said forward area.

2. The automated multiple-needle sewing device according to claim 1, wherein said lifting means is connected to one end of said one of said shafts, whereas said gear means is connected to another end of said one of said shafts, so that said one of said shafts is raised at said one end to allow said guide means to pass therethrough when said guide means returning mechanism is operated to return said guide means to said forward area.

3. The automated multiple-needle sewing device according to claim 1, wherein said lifting means and said gear means are connected to both ends of said one of said shafts, whereby a whole of said one of said shafts is raised out of contact with said material to allow said guide means to pass therethrough when said guide means returning mechanism is operated to return said guide means to said forward area.

4. The automated multiple-needle sewing device according to claim 1, wherein said feed roller is driven in synchronism with a feeding operation of said multiple-needle sewing device at a same speed.

5. The automated multiple-needle sewing device according to claim 1, wherein said gear means comprises a first gear and a second gear which are meshed with each other, wherein one of said first and second gears is operatively connected with said driving source and another of them is fixed to said one of said shafts, and wherein there is provided a biasing device for biasing said one of said shafts in a direction to cause said feed roller to contact with said material, to thereby keep said first and second gears in mesh with each other.

6. The automated multiple-needle sewing device according to claim 5, wherein both of said first and second gears have gear teeth of a length sufficient to keep them in mesh with each other even when one of said two gears is raised away from another of them with operation of said lifting means for lifting said one of said shafts.

7. The automated multiple-needle sewing device according to claim 1, wherein said guide means has a clamp means provided thereon for securing said material, wherein a cylinder means is provided for moving said guide means toward said multiple-needle sewing mechanism, and wherein said multiple-needle sewing mechanism includes a feed teeth member for feeding said material for sewing in synchronism with a feeding operation of said feed roller mechanism at a same speed.

8. The automated multiple-needle sewing device according to claim 1, wherein a keel member is provided in front of said multiple-needle sewing mechanism at said forward area, so as to stretch said material in order to avoid creation of creases thereon.

9. The automated multiple-needle sewing device according to claim 1, wherein said feed roller comprises at least one upper roller and at least one lower roller, and wherein both said guide means and material thereon are sandwiched between said upper and upper rollers and thereby fed in a direction toward said yarn cutting mechanism.

10. The automated multiple-needle sewing device according to claim 1, wherein said guide means returning mechanism includes a cylinder means for pressing and returning said guide means to an initial area at said forward area, when said guide means reaches a point at said guide means returning mechanism.

11. The automated multiple-needle sewing device according to claim 10, wherein said guide means returning mechanism includes a retainer means for pressingly retaining said material at a point in said rearward area where said guide means returning mechanism lies, when said guide means is returned to said initial area by said cylinder means.

* * * * *